US010535309B2

(12) United States Patent
Ryu et al.

(10) Patent No.: US 10,535,309 B2
(45) Date of Patent: Jan. 14, 2020

(54) ORGANIC LIGHT EMITTING DISPLAY AND DRIVING METHOD THEREOF

(71) Applicant: LG Display Co., Ltd., Seoul (KR)

(72) Inventors: Hojin Ryu, Goyang-si (KR); Minchul Byun, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 87 days.

(21) Appl. No.: 15/608,700

(22) Filed: May 30, 2017

(65) Prior Publication Data

US 2017/0345378 A1 Nov. 30, 2017

(30) Foreign Application Priority Data

May 31, 2016 (KR) ..... 10-2016-0067304

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01); *G09G 2300/0861* (2013.01)

(58) Field of Classification Search
CPC .. G09G 3/3291; G09G 3/3225; G09G 3/3233; G09G 2300/0819; G09G 2300/0861; G09G 2320/046; G09G 2320/0666; G09G 2320/103
See application file for complete search history.

(56) References Cited

U.S. PATENT DOCUMENTS

2004/0178974 A1* 9/2004 Miller ..... G09G 3/3216 345/82
2007/0222711 A1* 9/2007 Kao ..... G09G 3/2944 345/63
2010/0149223 A1* 6/2010 Betts-LaCroix ..... G09G 3/3216 345/690

* cited by examiner

*Primary Examiner* — Wing H Chow
(74) *Attorney, Agent, or Firm* — Polsinelli PC

(57) ABSTRACT

Disclosed is an organic light emitting display including: a display panel having a plurality of pixels arranged thereon; a degradation reduction circuit configured to detect a highly luminous still image pattern by analyzing input image data, and change a correlated color temperature (CCT) of a vulnerable color having the shortest lifespan in still image data corresponding to pixels displaying the highly luminous still image pattern so as to modulate the input image data into a degradation reduced data; and a display panel driving circuit configured to provide an analog data voltage, corresponding to the degradation.

11 Claims, 7 Drawing Sheets

ORGANIC LIGHT EMITTING DISPLAY AND DRIVING METHOD THEREOF

CROSS REFERENCE TO RELATED APPLICATION

This application claims the benefit of Korea Patent Application No. 10-2016-0067304 filed on May 31, 2016, which is incorporated by reference in its entirety for all purposes as if fully set forth herein.

BACKGROUND

Field of the Disclosure

The present disclosure relates to a display device, and more particularly, an organic light emitting display and a driving method thereof. Although the present disclosure is suitable for a wide scope of applications, it is particularly suitable for reducing degradation in a region where a highly luminous still image pattern is displayed, so that the life span of the display can be improved.

Description of the Background

An active matrix organic light emitting display includes an organic light emitting Diodes (hereinafter, abbreviated to "OLEDs") capable of emitting light by itself and has advantages of a fast response time, a high light emitting efficiency, a high luminance, a wide viewing angle, etc.

An OLED serving as a self-emitting element includes an anode electrode, a cathode electrode, and an organic compound layer formed between the anode electrode and the cathode electrode. The organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

An organic light emitting display includes pixels arranged in a matrix form thereon, each pixel including an OLED, and adjusts luminance of the pixels according to a grayscale level of video data. As illustrated in FIG. 1A, each pixel includes a driving thin film transistor (TFT) DT controlling a driving current flowing in the OLED, and a switching unit SC programming a gate-source voltage (hereinafter, referred to as "Vgs") of the driving TFT DT. The driving TFT DT generates a drain-source current (hereinafter, referred to as "Ids" according to the programmed Vgs, and supplies a current Ids to the OLED as a driving voltage. A light emitting amount of the OLED depends on a driving current.

To enable a driving current to flow in each pixel, an electrode on one side of the driving TFT DT (for example, a drain electrode) is connected to a high-potential pixel power VDDEL, and a cathode electrode of the OLED is connected to a low-potential pixel power VSSEL. For stable operation of the driving TFT DT, the high-potential pixel power VDDEL is set in a saturation region which is a region in which the source-drain current Ids of the driving TFT DT is maintained at a constant level in the Vds-Ids plane, as shown in FIG. 1B, regardless of the source-drain voltage Vds of the driving TFT DT.

Electrical characteristics of the OLED and the driving TFT are degraded as a driving time passes. If the OLED is degraded, an operating point voltage (which is indicated as Voled in FIG. 1A), at which the OLED is capable of being turned on, is increased and a light emitting efficiency is reduced. In addition, if the driving TFT is degraded, a threshold voltage of the driving TFT is changed. A level of degradation of an OLED and a level of degradation of a driving TFT may be different at each pixel. Difference in degradation between pixels may result in luminance deviation, which could possibly lead to an image sticking phenomenon.

Degradation of the OLED and the driving TFT is proportional to an accumulated emitting time and luminance. For example, a highly luminous still image pattern, such as a broadcasting company logo shown in FIG. 2, is displayed with high luminance at a specific location in an image for a long time. Thus, pixels displaying the highly luminous still image pattern become degraded, thereby causing an after-image to occur relatively fast, compared to other pixels, and thus reducing the lifespan of a display.

SUMMARY

Accordingly, the present disclosure is directed to an organic light emitting display and a driving method, that substantially obviate one or more problems due to limitations and disadvantages of the prior art. Additional features and advantages of the disclosure will be set forth in the description which follows and in part will be apparent from the description, or may be learned by practice of the disclosure. The objectives and other advantages of the disclosure will be realized and attained by the structure particularly pointed out in the written description and claims hereof as well as the appended drawings.

To achieve these and other advantages and in accordance with the purpose of the present disclosure, as embodied and broadly described, an organic light emitting display includes a display panel having a plurality of pixels arranged thereon; a degradation reduction circuit configured to detect a highly luminous still image pattern by analyzing input image data, and change a Correlated Color Temperature (CCT) of a vulnerable color having the shortest lifespan in still image data corresponding to the highly luminous still image pattern so as to modulate the input image data into a degradation reduced data; and a display panel driving circuit configured to provide an analog data voltage, corresponding to the degradation reduced data, to pixels that display the high luminance still image pattern.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate aspects of the disclosure and together with the description serve to explain the principles of the disclosure.

In the drawings.

DETAILED DESCRIPTION OF THE ILLUSTRATED ASPECTS

Figure 1A:
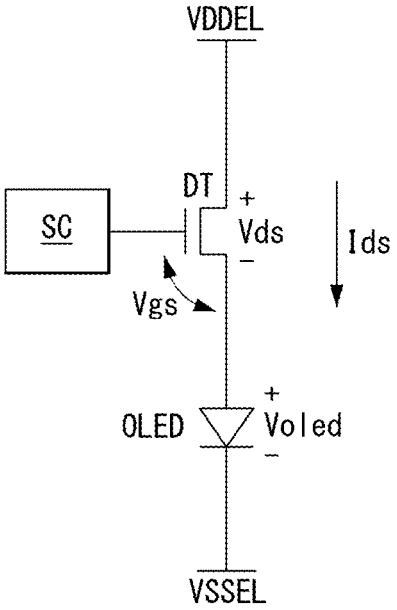
FIG. 1A (RELATED ART)
FIG. 1A is an equivalent circuit of a pixel included in an organic light emitting display device.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In description of aspects of the present disclosure, when a relationship of two elements is described using "on~", "above~", "below~", "next~", etc., this description should be construed as one or more elements can be positioned between the two elements unless "directly" is used.

In description of aspects of the present disclosure, when an element or layer is "on" a different element or layer, this description should be construed in that another layer or element is on the different element or positioned between the two elements.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The same reference numerals denote the same elements throughout the specification.

The size and thickness of each element in the drawings are illustrated by way of example, and aspects of the present disclosure are not limited thereto.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, various aspects of the present disclosure will be described in detail with reference to the accompanying drawings.

Figure 3:
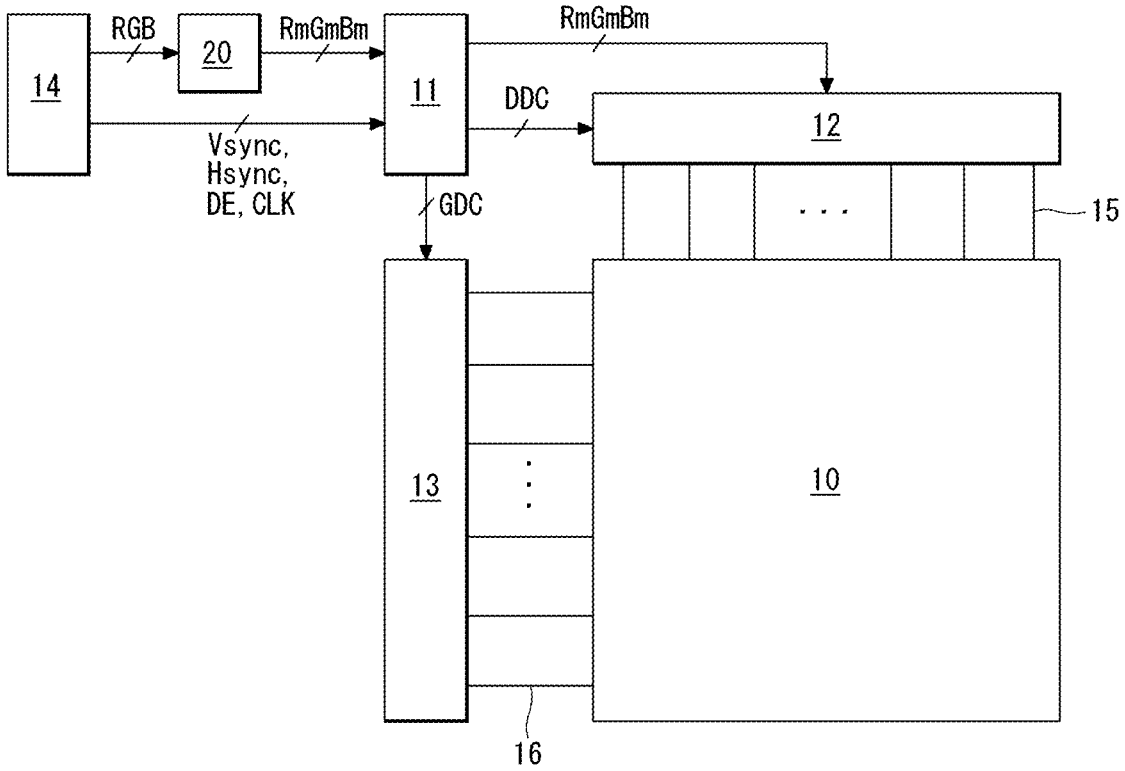
FIG. 3 is a block diagram illustrating an organic light emitting display device according to an aspect of the present disclosure.

FIG. 3 is a block diagram illustrating an organic light emitting display device according to an aspect of the present disclosure.

Figure 1B:
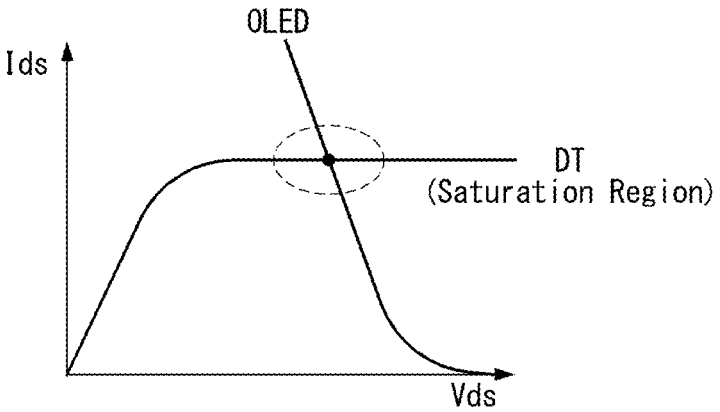
FIG. 1B (RELATED ART)
FIG. 1B is a diagram illustrating respective operating characteristics curves of a driving thin film transistor (TFT) and an organic light emitting Diode (OLED), each included in the pixel shown in FIG. 1.
Figure 2:
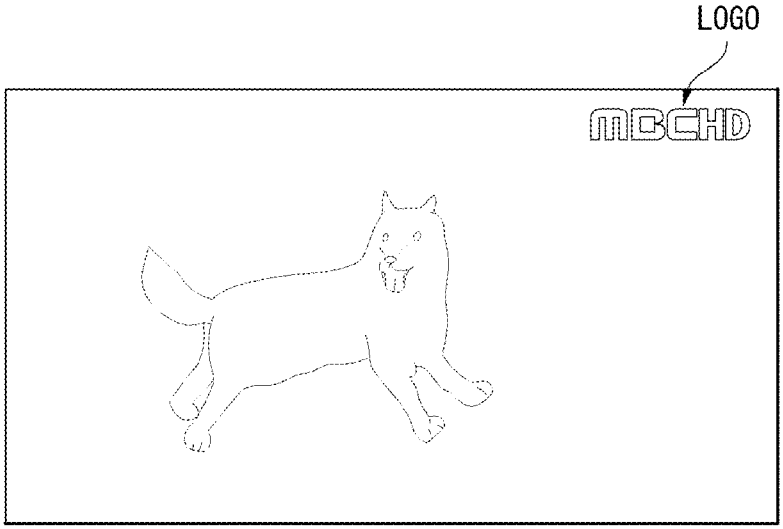
FIG. 2 (RELATED ART)
FIG. 2 is a diagram illustrating an image displayed on an organic light emitting display device which includes a logo region that is degraded relatively fast.

Referring to FIGS. 1A and 1B in addition to FIG. 3, an organic light emitting display according to an aspect of the present disclosure includes a display panel 10, a timing controller 11, a display panel driving circuit 12 and 13, a host system 14, and a degradation reduction circuit 20.

A plurality of data lines 15 and a plurality of gate lines 16 cross each other on the display panel 10, and pixels are arranged at each intersection in a matrix form to thereby form a pixel array.

A pixel may be one of a first pixel implementing Red Rc, a second pixel for implementing Green Gc, and a third pixel for implementing Blue Bc. Each pixel may be connected to one of the data lines 15 and one of the gate lines 16. As illustrated in FIG. 1A, each pixel includes a driving Thin Film Transistor (TFT) DT controlling a driving current applied to an organic light emitting diode (OLED), and a switching unit SC programing a gate-source voltage (hereinafter, referred to as "Vgs") of the driving TFT DT. The driving TFT DT generates a drain-source current (hereinafter, referred to as "Ids") according to the programmed Vgs, and provides Ids to the OLED as a driving current. A light-emitting amount of the OLED depends on the driving current.

To enable a driving current to flow in each pixel, an electrode of one side of the driving TFT DT (for example, a drain electrode) is connected to a high-potential pixel power VDDEL and a cathode electrode of the OLED is connected to a low-potential pixel power VSSEL. For stable operation of the driving TFT DT, the high-potential pixel power VDDEL may be set in a saturation region which is a region in which the source-drain current Ids of the driving TFT DT is maintained at a constant level in the Vds-Ids plane, as shown in FIG. 1B, regardless of the source-drain voltage Vds of the driving TFT DT.

TFTs of a pixel may be implemented as a P-type, an N-type or a hybrid type. In addition, a semiconductor layer of each TFT may be an amorphous silicon semiconductor layer, a polysilicon semiconductor layer, or an oxide semiconductor layer.

The degradation reduction circuit 20 is intended to reduce an afterimage time by reducing degradation of a region in which a highly luminous still image pattern is displayed. The degradation reduction circuit 20 detects the highly luminous still image pattern by analyzing image data RGB which is input from the host system 14. The input image data RGB includes red data R to be applied to the first pixel, green data G to be applied to the second pixel, and blue data B to be applied to the third pixel. Then, the degradation reduction circuit 20 may modulate the input image data RGB into degradation reduced data RmGmBm by changing correlated color temperature (CCT) of a vulnerable color which has the shortest lifespan in still image data corresponding to the highly luminous still image pattern. Various aspects and detailed operations of the degradation reduction circuit 20 will be described with reference to FIGS. 4 to 10.

The timing controller 11 may provide the degradation reduced data RmGmBm, which is received from the degradation reduction circuit 20, to the data driving circuit 12 in various interface methods such as mni-LVDS.

The timing controller 11 receives a timing signal, such as a vertical synchronization Vsync, a horizontal synchronization signal Hsync, a data enable signal DE, and a dot clock CLT, from the host system 14, and generates control signals for controlling operation timing of the data driving circuit 12 and the gate driving circuit 13. The control signals include a gate timing control signal GDC for controlling operation timing of the gate driving circuit 12, and a source timing control signal DDC for controlling operation timing of the data driving circuit 12.

The display panel driving circuit 12 and 13 provides an analog data voltage, corresponding to the degradation reduced data RmGmBm, to pixels which display the highly luminous still image pattern. To this end, the display panel driving circuit includes a data driving circuit 12 and a gate driving circuit 13.

The data driving circuit 12 converts the degradation reduced data RmGmBm into an analog data voltage based on a source timing control signal DDC, and provides the data voltage to the data lines 15. The gate driving circuit 13 generates a gate signal based on the gate timing control signal GDC, and provides the gate signal to the gate lines 16. A switching unit SC of each pixel is turned on in response to the gate signal to apply a data voltage, which is charged in the data lines 15, to a gate electrode of the driving TFT DT.

Figure 4:
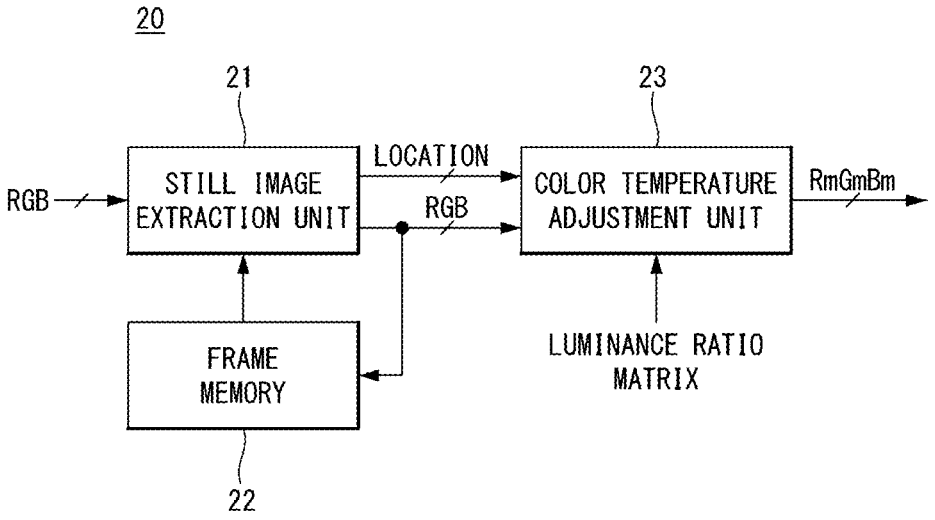
FIG. 4 is a diagram illustrating a degradation reduction circuit according to an aspect of the present disclosure.

FIG. 4 illustrates a degradation reduction circuit according to an aspect of the present disclosure.

Referring to FIG. 4, the degradation reduction circuit 20 according to an aspect of the present disclosure includes a still image extraction unit 21, a frame memory 22, and a color temperature adjustment unit 23.

The frame memory 22 stores input image data RBG of one frame.

The still image extraction unit 21 extracts location information of the highly luminous still image pattern by analyzing image data, stored in the frame memory 22, using a preset image analytical algorithm. The highly luminous still image means a still image having not less than 25% of the maximum luminance (100%) of the display panel 10 and remains unchanged for 30 seconds or more.

The highly luminous still image pattern is an image pattern that is displayed with high luminance at a specific location in an image for a long time, and the highly luminous still image pattern may be, for example, a broadcasting company logo. However, the highly luminous still image pattern is not limited to the broadcasting company logo, and may be applied to other various still image patterns.

While maintaining luminance of a region in which the highly luminous still image pattern is displayed, the color temperature adjustment unit 23 reduces a luminance ratio of a vulnerable color having the shortest lifespan in still image data RGB of first to third colors Rc, Gc, and Bc corresponding to the location information, so that a CCT of the vulnerable color is reduced.

To this end, the color temperature adjustment unit 23 loads a preset luminance ratio matrix, and calculates a white luminance ratio of a CCT ($LR_R$, $LR_G$, $LR_B$), which is a target to be changed, as shown in Equation 1 by multiplying an inverse luminance ratio matrix by sets of white color coordinates $X_W$, $Y_W$, $Z_W$ of a display.

$$Inv\left(\begin{bmatrix} X_R & X_G & X_B \\ Y_R & Y_G & Y_B \\ Z_R & Z_G & Z_B \end{bmatrix}\right) \times \begin{bmatrix} X_W \\ Y_W \\ Z_W \end{bmatrix} = \begin{bmatrix} LR_R \\ LR_G \\ LR_B \end{bmatrix} \quad \text{[Equation 1]}$$

Then, the color temperature adjustment unit 23 applies the still image data RGB of the first to third colors Rc, Gc, and Bc to the color temperature conversion algorithm as in Equation 2, so that a luminance ratio and a CCT of a vulnerable color is reduced and a color temperature conversion result R'G'B' is detected. The color temperature adjustment unit 23 outputs the color temperature conversion result R'G'B' as degradation reduced data RmGmBm. In Equation 2, $LR_{R(D)}$, $LR_{G(D)}$, and $LR_{B(D)}$ indicate a preset default white luminance ratio of CCTs with respect to a display, and $LR_{R(T)}$, $LR_{G(T)}$, $LR_{B(T)}$ indicate a while luminance ratio of a CCT to a target value to be changed.

$$\begin{bmatrix} R' \\ G' \\ B' \end{bmatrix} = Inv\left(\begin{bmatrix} X_R \cdot LR_{R(D)} & X_G \cdot LR_{G(D)} & X_B \cdot LR_{B(D)} \\ Y_R \cdot LR_{R(D)} & Y_G \cdot LR_{G(D)} & Y_B \cdot LR_{B(D)} \\ Z_R \cdot LR_{R(D)} & Z_G \cdot LR_{G(D)} & Z_B \cdot LR_{B(D)} \end{bmatrix}\right) \times \begin{bmatrix} X_R \cdot LR_{R(T)} & X_G \cdot LR_{G(T)} & X_B \cdot LR_{B(T)} \\ Y_R \cdot LR_{R(T)} & Y_G \cdot LR_{G(T)} & Y_B \cdot LR_{B(T)} \\ Z_R \cdot LR_{R(T)} & Z_G \cdot LR_{G(T)} & Z_B \cdot LR_{B(T)} \end{bmatrix} \times \begin{bmatrix} R \\ G \\ B \end{bmatrix} \quad \text{[Equation 2]}$$

As such, while maintaining luminance of a region in which a highly luminous still image pattern (for example, a logo pattern) is displayed, the color temperature adjustment unit 23 reduces a luminance ratio of a vulnerable color, so that a CCT of the vulnerable color is reduced. As shown in Table 1, the afterimage time improvement rate increases if a luminance ratio and a CCT of a vulnerable color are reduced.

TABLE 1

| Luminance of Logo | CCT | 9200K | 8166K | 7300K | 6570K |
|---|---|---|---|---|---|
| | Color Coordinates | 0.285<br>0.294 | 0.293<br>0.305 | 0.301<br>0.318 | 0.311<br>0.332 |
| 100% | Afterimage Time Improvement RAte | 0.0% | 8.6% | 16.9% | 25.4% |

As such, while maintaining luminance of a still image pattern region, the degradation reduction circuit 20 according to an aspect of the present disclosure relatively reduces luminance of a vulnerable color to thereby change a CCT, so that degradation in a highly luminous still image pattern such as a logo is reduced. For example, in the case where Blue has a relatively short lifespan at a CCT of 9200K as shown in (1) of FIG. 7, the degradation reduction circuit 20 according to an aspect of the present disclosure reduces a CCT of Blue to 8166K, 7300K, or 6570K, while maintaining luminance of a logo pattern, so that the afterimage time of Blue is reduced.

Figure 5:
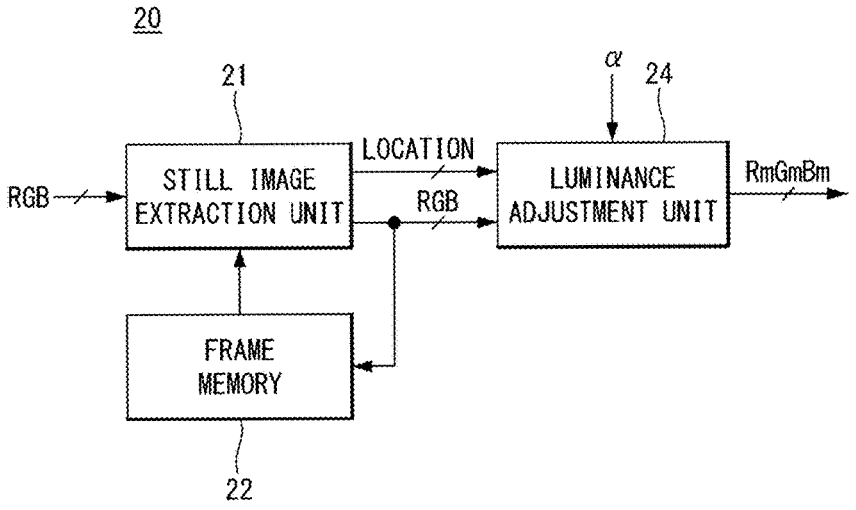
FIG. 5 is a diagram illustrating a degradation reduction circuit according to another aspect of the present disclosure.

FIG. 5 illustrates a degradation reduction circuit according to another aspect of the present disclosure.

Referring to FIG. 5, a degradation reduction circuit 20 according to another aspect of the present disclosure includes a still image extraction unit 21, a frame memory 22, and a luminance adjustment unit 24.

The frame memory 22 stores input image data RGB of one frame.

The still image extraction unit 21 extracts location information of the highly luminous still image pattern by analyzing image data, stored in the frame memory 22, using a preset image analytical algorithm. The highly luminous still image pattern is an image pattern that is displayed with high luminance at a specific location in an image for a long time, and the highly luminous still image pattern may be, for example, a broadcasting company logo. However, the highly luminous still image pattern is not limited to the broadcasting company logo, and may be applied to other various still image patterns.

The luminance adjustment unit 24 reduces luminance of a vulnerable color which has the shortest lifespan in still image data of the first to third color Rc, Gc, and Bc corresponding to the location information, so that a CCT of the vulnerable color is reduced. To this end, the luminance adjustment unit 24 modulates the still image data of the first to third color Rc, Gc, and Bc based on a luminance reduction rate ($\alpha$), which is preset for the vulnerable color, to output degradation reduced data RmGmBm.

As such, the degradation reduction circuit 20 according to another aspect of the present disclosure reduces luminance of the vulnerable color, thereby reducing degradation of a highly luminous still image pattern such as a logo. For example, in the case where Blue is vulnerable at a CCT of 9200K as shown in (2) of FIG. 7, the degradation reduction circuit 20 according to another aspect of the present disclosure sequentially reduces luminance of Blue approximately to 80%. As a result, the CCT of Blue may be indirectly reduced to 8166K, 7300K, or 6570K, and thus, the afterimage time of Blue may be reduced.

Figure 6:
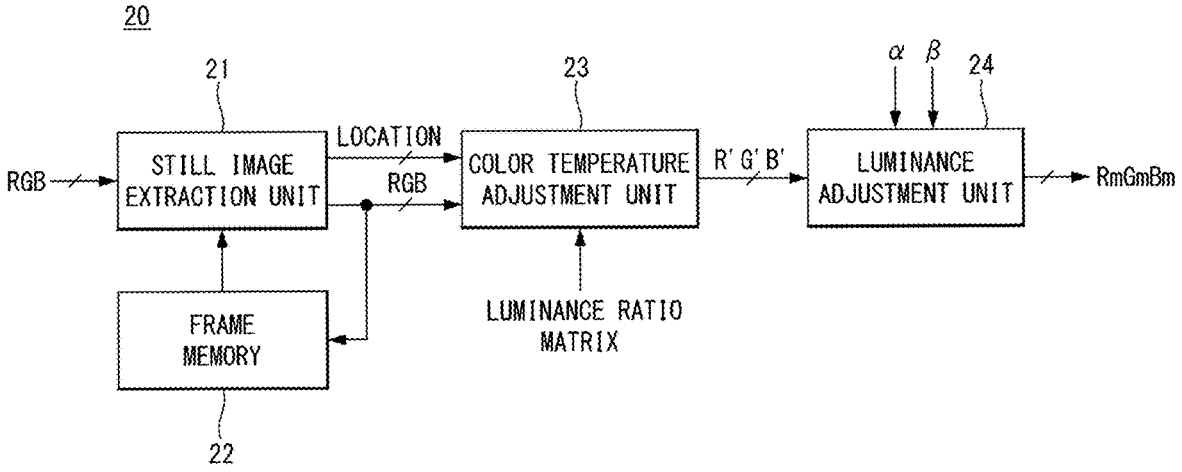
FIG. 6 is a diagram illustrating a degradation reduction circuit according to yet another aspect of the present disclosure.
Figure 7:
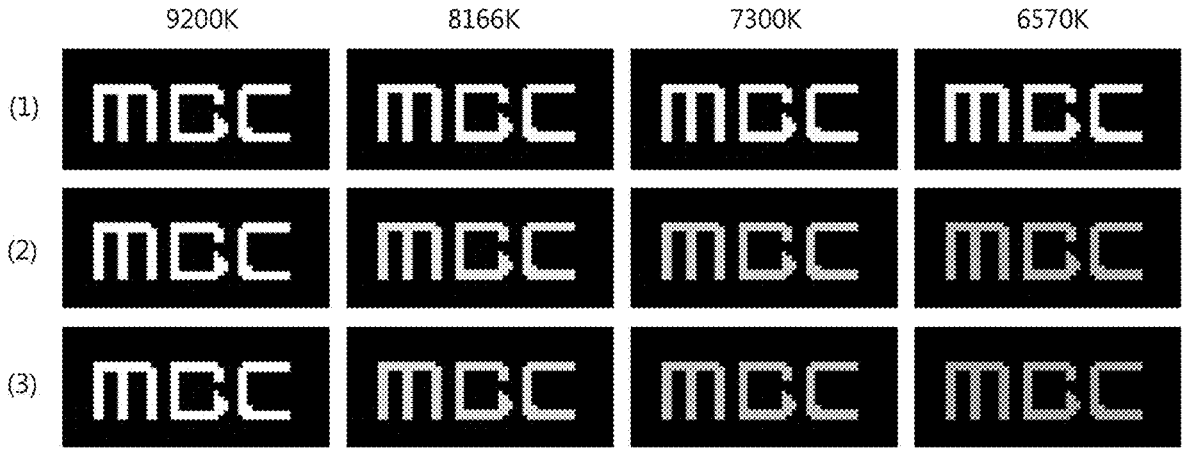
FIG. 7 is a diagram illustrating examples of change in a correlated color temperature (CCT) due to degradation reduction circuits shown in FIGS. 4 to 6.

FIG. 6 illustrates a degradation reduction circuit according to yet another aspect of the present disclosure.

Referring to FIG. 6, a degradation reduction circuit 20 according to yet another aspect of the present disclosure includes a still image extraction unit 21, a frame memory 22, a color temperature adjustment unit 23, and a luminance adjustment unit 24.

The frame memory 22 stores input image data RBG of one frame.

The still image extraction unit 21 extracts location information of the highly luminous still image pattern by analyzing image data, stored in the frame memory 22, using a preset image analytical algorithm. The highly luminous still image pattern is an image pattern that is displayed with high luminance at a specific location in an image for a long time, and the highly luminous still image pattern may be, for example, a broadcasting company logo. However, the highly luminous still image pattern is not limited to the broadcasting company logo, and may be applied to other various still image patterns.

While maintaining luminance of a region in which the highly luminous still image pattern is displayed, the color temperature adjustment unit 23 reduces a CCT of a vulnerable color which has the shortest lifespan in still image data RGB of first to third colors Rc, Gc, and Bc corresponding to the location information. In this manner, the color temperature adjustment unit 23 primarily reduces the CCT of the vulnerable color and output intermediate modulated data R'G'B'. To this end, the color temperature adjustment unit 23 may operate as described above with reference to Equation 1, Equation 2, and Table 1.

The luminance adjustment unit 24 reduces luminance of a vulnerable color in a still image data of first to third colors Rc, Gc, and Bc corresponding to the location information within the intermediate modulated data R'G'B', so that the CCT of the vulnerable color is secondarily reduced. To this end, the luminance adjustment unit 24 modulates the still image data of the first to third colors Rc, Gc, and Bc based on a luminance reduction ratio ($\beta$), which is preset for a still image pattern region, so that degradation reduced data RmGmBm is output as final modulated data.

Table 2 shows the change in a luminance ratio and luminance of Blue, which is a vulnerable color, in a still image pattern region (for example, a logo pattern region), and a resulting afterimage time improvement rate. As shown in Table 2, the afterimage time improvement rate increases if a CCT and luminance of a logo are all reduced according to a luminance ratio of a vulnerable color (Blue).

TABLE 2

| CCT | Blue | 100% | 90% | 80% | 70% |
|---|---|---|---|---|---|
| | Luminance of Logo | 100% | 99% | 97% | 96% |
| 9200K | AfterImage Time Improvement Rate | 0.0% | 13.2% | 29.3% | 49.2% |
| 8166K | AfterImage Time Improvement Rate | 3.9% | 16.7% | 32.1% | 50.9% |
| 7300K | AfterImage Time Improvement Rate | 8.2% | 20.5% | 35.0% | 52.4% |
| 6570K | AfterImage Time Improvement Rate | 13.1% | 24.8% | 38.4% | 54.3% |

By reducing a luminance ratio and luminance of a vulnerable color, the degradation reduction circuit 20 according to the third aspect of the present disclosure reduces degradation in a highly luminous still image pattern, such as a logo, more efficiently. For example, in the case where Blue is vulnerable at a CCT of 9200K as shown in (3) of FIG. 7, the degradation reduction circuit 20 according to the third aspect of the present disclosure sequentially reduces luminance of Blue approximately to 80% and directly reduces the CCT of Blue to 8166K, 7300K, or 6570K, and thus, the afterimage time of Blue may be reduced more efficiently.

Figure 8:
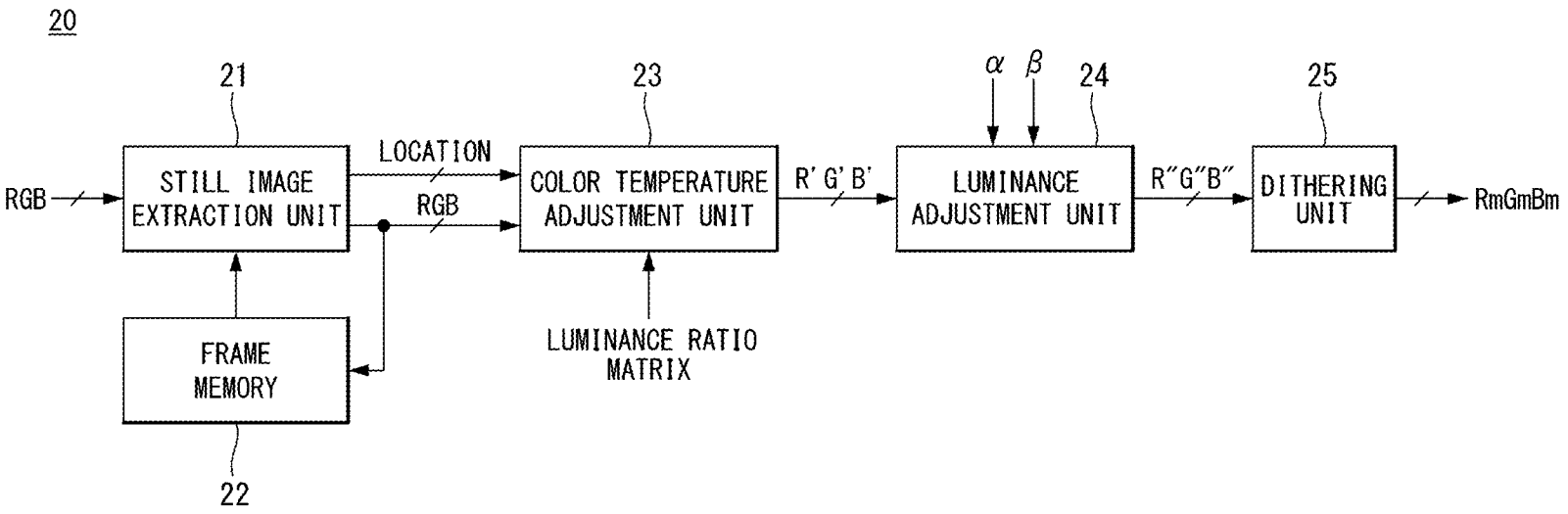
FIG. 8 is a diagram illustrating a degradation reduction circuit according to a further aspect of the present disclosure.
Figure 9:
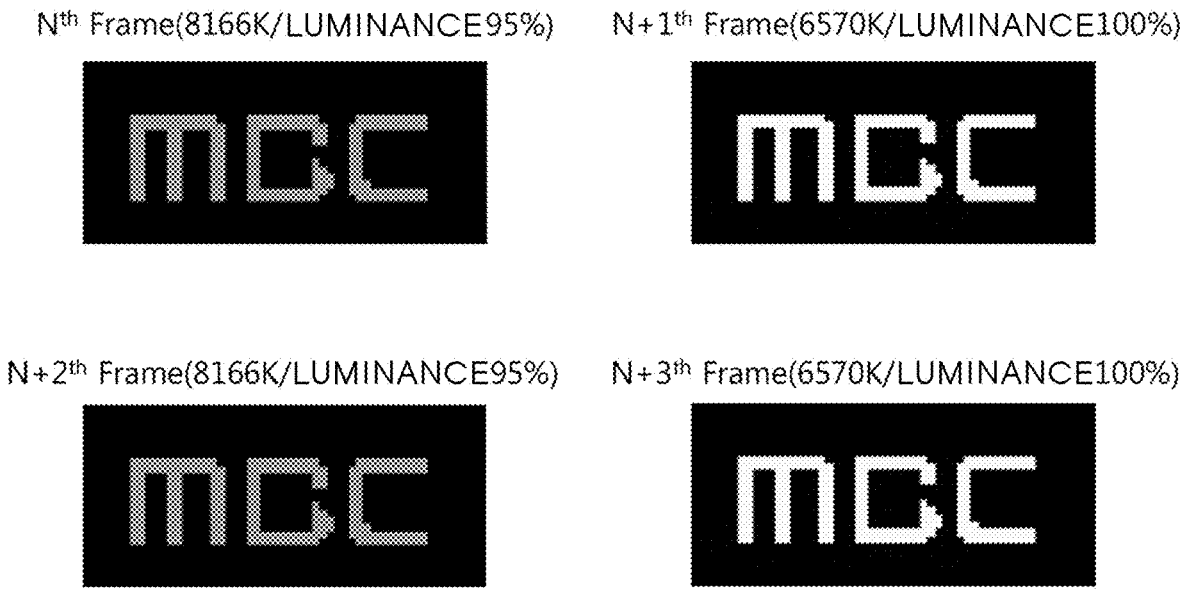
FIG. 9 is a diagram illustrating an example of the change in a CCT in each frame due to a dithering unit shown in FIG. 8
Figure 10:
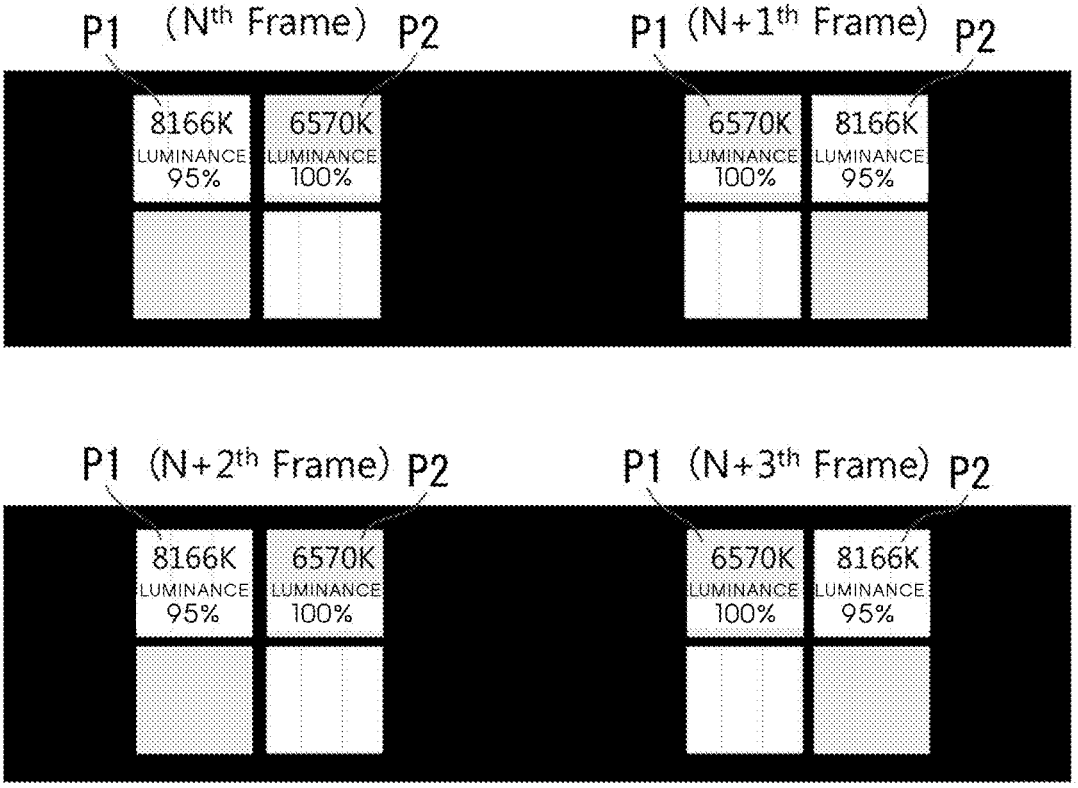
FIG. 10 is a diagram illustrating an example of the change in a CCT at each pixel due to a dithering unit shown in FIG. 8.

FIG. 8 illustrates a degradation reduction circuit according to a further aspect of the present disclosure. FIG. 9 illustrates an example of the change in a CCT in each frame due to a dithering unit shown in FIG. 8. FIG. 10 shows an example of the change in a CCT at each pixel due to the dithering unit shown in FIG. 8.

Referring to FIG. 8, the degradation reduction circuit 20 according to the fourth aspect of the present disclosure includes a still image extraction unit 21, a frame memory 22, a color temperature adjustment unit 23, a luminance adjustment unit 24, and a dithering unit 25.

The frame memory 22 stores input image data RBG of one frame.

The still image extraction unit 21 extracts location information of the highly luminous still image pattern by analyzing image data, stored in the frame memory 22, using a preset image analytical algorithm. The highly luminous still image pattern is an image pattern that is displayed with high luminance at a specific location in an image for a long time, and the highly luminous still image pattern may be, for example, a broadcasting company logo. However, the highly luminous still image pattern is not limited to the broadcasting company logo, and may be applied to other various still image patterns.

While maintaining luminance of a region in which a highly luminous still image pattern is displayed, the color temperature adjustment unit 23 reduces a CCT of a vulnerable color which has the shortest lifespan in still image data RGB of first to third colors Rc, Gc, and Bc corresponding to the location information. In this manner the color temperature adjustment unit 23 primarily reduces the CCT of the vulnerable color and outputs an intermediate modulated data R'G'B'. To this end, the color temperature adjustment unit 23 may operate as described above with reference to Equation 1, Equation 2, and Table 1.

The luminance adjustment unit 2 further reduces luminance of a vulnerable color in still image data of the first to third colors Rc, Gc, and Bc corresponding to the location information 4 within the intermediate modulated data R'G'B', so that a CCT of the vulnerable color is secondarily reduced. To this end, the luminance adjustment unit 23 outputs a second intermediate modulated data R"G"B" by modulating the still image data of the first to third colors Rc, Gc, and Bc based on a luminance reduction ratio (β) which is preset for a still image pattern region.

The dithering unit 25 complementarily changes a degree of adjustment of the CCT and a degree of adjustment of the luminance within the second intermediate modulated data R"G"B" at specific intervals, and outputs degradation reduced data RmGmBm as final modulated data. The dithering unit 25 temporally distributes a degree of adjustment of the CCT and a degree of adjustment of the luminance, so that the equal luminance of a vulnerable color may be perceived and therefore flickering may be prevented.

For example, as illustrated in FIG. 9, the dithering unit 25 may increase a CCT of a vulnerable color in odd-numbered frames (the $n^{th}$ frame and the $n+2^{th}$ frame) to 8166K and reduce luminance of the vulnerable color to 95%, while reducing a CCT of the vulnerable color in even-numbered frames (the $n+1^{th}$ frame and the $n+3^{th}$ frame) to 6570K and increasing luminance of the vulnerable color to 100%. In doing so, the equal luminance of a vulnerable color may be perceived.

Meanwhile, the dithering unit 25 further complementarily changes a degree of adjustment of the CCT and a degree of adjustment of the luminance at specific locations within the temporally-distributed second intermediate modulated data R"G"B", and outputs degradation reduced data RmGmBm as final modulated data. The dithering unit 25 spatially distributes a degree of adjustment of the CCT and a degree of adjustment of the luminance, so that the equal luminance of a vulnerable color may be perceived and thus flickering may be prevented more efficiently.

For example, as illustrated in FIG. 10, the dithering unit 25 may increase a CCT of a vulnerable color at a first pixel P in in odd-numbered frames (the $n^{th}$ frame and the $n+2^{th}$ frame) to 8166K and reduce luminance of the vulnerable color to 95%, while reducing a CCT of the vulnerable color at a second pixel P2 neighboring the first pixel P to 6270K and increasing luminance of the vulnerable color to 100%. On contrary, as illustrated in FIG. 10, the dithering unit 25 may reduce a CCT of a vulnerable color at a first pixel P in even-numbered frames (the $n+1^{th}$ frame and the $n+3^{th}$ frame) to 6570K and increases luminance of the vulnerable color to 100%, while increasing a CCT of a vulnerable color at a second pixel P2 to 8166K and reducing luminance of the vulnerable color to 95%.

As described above, the present disclosure detects a highly luminous still image pattern by analyzing input image data, and changes a CCT of a vulnerable color having the shortest lifespan in still image data corresponding to the highly luminous still image pattern, so that degradation in a region in which the highly luminous still image pattern is displayed may be reduced and therefore the afterimage time may be reduced.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. An organic light emitting display comprising:

a display panel;

a degradation reduction circuit configured to detect a still image pattern by analyzing input image data, and change a correlated color temperature (CCT) of a vulnerable color having the shortest lifespan in still image data corresponding to pixels displaying the still image pattern so as to modulate the input image data into a degradation reduced data; and a display panel driving circuit configured to provide an analog data voltage, corresponding to the degradation reduced data, to the pixels that display the still image pattern, wherein the degradation reduction circuit comprises:

a frame memory configured to store the input image data;

a still image extractor configured to extract location information of the still image pattern by analyzing the input image data stored in the frame memory; and a color temperature adjuster configured to reduce a luminance ratio and the CCT of the vulnerable color in still image data of a first color, a second color and a third color corresponding to the location information, wherein the vulnerable color is only one of the first color, the second color and the third color, wherein an entire luminance of a region in which the still image pattern of the first color, the second color and the third color is displayed remains unchanged for a period of displaying the still image pattern even though the luminance ratio and the CCT of the vulnerable color are reduced for the period of displaying the still image pattern.

2. The organic light emitting display of claim 1, wherein the degradation reduction circuit further comprises:

a luminance adjuster configured to additionally reduce luminance and the CCT of the vulnerable color in the still image data of the first color, a second color and the third color corresponding to the location information within intermediate modulated data.

3. The organic light emitting display of claim 2, wherein the degradation reduction circuit further comprises:

a dithering circuit configured to complementarily change, at specific intervals, a degree of adjustment of the CCT and a degree of adjustment of the luminance within second intermediate modulated data in which the CCT of the vulnerable color is additionally reduced.

4. The organic light emitting display of claim 3, wherein the dithering circuit further complementarily changes the degree of adjustment of the CCT and the degree of adjustment of the luminance at specific locations.

5. A driving method of an organic light emitting display having a plurality of pixels arranged thereon, the method comprising:

modulating input image data into a degradation reduced data by detecting a still image pattern through analysis the input image data and changing a Correlated Color Temperature (CCT) of a vulnerable color having the shortest lifespan in still image data corresponding to the still image pattern; and providing an analog data voltage, corresponding to the degradation reduced data, to pixels that display the still image patter, wherein the modulating of the input image data into the degradation reduction data comprises:

storing the input image data in a frame memory;

extracting location information of the still image pattern by analyzing the input image data stored in the frame memory; and while maintaining an entire luminance of a region in which the still image pattern of a first color, a second color and a third color is displayed, reducing a luminance ratio and the CCT of the vulnerable color in still image data of the first color, the second color and the third color corresponding to the location information, wherein the vulnerable color is only one of the first color, the second color and the third color, wherein an entire luminance of a region in which the still image pattern of the first color, the second color and the third color is displayed remains unchanged for a period of displaying the still image pattern even though the luminance ratio and the CCT of the vulnerable color are reduced for the period of displaying the still image pattern.

6. The driving method of claim 5, wherein the modulating of the input image data into the degradation reduction data further comprises:

further reducing luminance and the CCT of the vulnerable color in still image data of the first color, a second color and the third colors corresponding to the location information within intermediate modulated data.

7. The driving method of claim 6, wherein the modulating of the input image data into the degradation reduction data further comprises:

complementarily changing, at specific intervals, a degree of adjustment of the CCT and a degree of adjustment of the luminance within second intermediate modulated data in which the CCT of the vulnerable color is additionally reduced.

8. The driving method of claim 7, wherein the modulating of the input image data into the degradation reduction data further comprises:

complementarily changing the degree of adjustment of the CCT and the degree of adjustment of the luminance at specific locations.

9. An organic light emitting display comprising:

a display panel;

a degradation reduction circuit generating a degradation reduced data, wherein the degradation reduced data is generated by analyzing input image data and reference image data, determining location information of a still image pattern having a vulnerable color of the shortest life span, adjusting a correlated color temperature (CCT) of the vulnerable color in still image data corresponding to pixels displaying the still image pattern, and modulating the input image data into a degradation reduced data; and a display panel driving circuit providing an analog data voltage corresponding to the degradation reduced data to the pixels displaying the still image pattern, wherein the input image data is modulated by reducing a luminance ratio and the CCT of the vulnerable color in the still image data of a first color, a second color and a third color corresponding to the location information with maintaining a luminance of a region where the still image pattern displayed, wherein the vulnerable color is only one of the first color, the second color and the third color, wherein an entire luminance of the region in which the still image pattern of the first color, the second color and the third color is displayed remains unchanged for a period of displaying the still image pattern even though the luminance ratio and the CCT of the vulnerable color are reduced for the period of displaying the still image pattern.

10. The organic light emitting display of claim 9, wherein the input image data is modulated by reducing a luminance ratio of the vulnerable color in the still image data of the first color, the second color and the third color corresponding to the location information with maintaining the luminance of the region where the still image pattern displayed, and further reducing luminance of the vulnerable color in the still image data of the first color, the second color and the third color corresponding to the location information within intermediate modulated data.

11. The organic light emitting display of claim 9, wherein the input image data is modulated by reducing a luminance ratio of the vulnerable color in the still image data of the first color, the second color and the third color corresponding to the location information with maintaining the luminance of the region where the still image pattern displayed, reducing luminance of the vulnerable color in the still image data of the first color, the second color and the third color corresponding to the location information within intermediate modulated data, and complementarily changing, at specific intervals, a degree of adjustment of the CCT and a degree of adjustment of the luminance within second intermediate modulated data in which the CCT of the vulnerable color is additionally reduced.

* * * * *